US006135091A

United States Patent [19]

Itoh et al.

[11] Patent Number: 6,135,091

[45] Date of Patent: Oct. 24, 2000

[54] FUEL INJECTION SYSTEM

[75] Inventors: Katsuoki Itoh, Leonberg; Friedrich Boecking, Stuttgart, both of Germany

[73] Assignee: Robert Bosch GmbH, Stuttgart, Germany

[21] Appl. No.: 09/109,546

[22] Filed: Jul. 2, 1998

[30] Foreign Application Priority Data

Jul. 2, 1997 [DE] Germany ..... 197 28 111

[51] Int. Cl.[7] ..... F02M 37/04

[52] U.S. Cl. ..... 123/456; 123/470

[58] Field of Search ..... 123/509, 470, 123/456, 468, 469, 472

[56] References Cited

U.S. PATENT DOCUMENTS

| | | | |
|---|---|---|---|
| 2,354,403 | 7/1944 | Reggio | 123/470 |
| 3,845,748 | 11/1974 | Eisenberg | 123/470 |
| 4,485,790 | 12/1984 | Nishimura | 123/470 |
| 5,121,731 | 6/1992 | Jones | 123/470 |
| 5,365,907 | 11/1994 | Dietrich | 123/470 |
| 5,392,749 | 2/1995 | Stockner | 123/470 |
| 5,398,658 | 3/1995 | Mesimaki | 123/456 |
| 5,617,828 | 4/1997 | Kuegel | 123/470 |

*Primary Examiner*—Carl S. Miller
*Attorney, Agent, or Firm*—Ronald E. Greigg; Edwin E. Greigg

[57] ABSTRACT

A fuel injection system in which a high pressure fuel reservoir is provided for supplying fuel injection valves. The valves are electrically controlled and are supplied in a correspondingly controlled fashion with fuel for injection from the high pressure fuel reservoir. The fuel injection valves are connected directly with their housings to the high pressure fuel reservoir in order to avoid the interposition of fuel lines.

18 Claims, 4 Drawing Sheets

FUEL INJECTION SYSTEM

BACKGROUND OF THE INVENTION

The invention is based on a fuel injection system. In a fuel injection system of this kind, which has been disclosed by DE-SO 43 41 546, a first high pressure fuel reservoir is provided as a high pressure fuel source which supplies second high pressure fuel reservoirs that are each associated with a fuel injection valve. Fuel from this second high pressure fuel reservoir is supplied to the fuel injection valve by way of an on-off valve. The high pressure fuel reservoirs are respectively connected to one another by way of high pressure lines. These lines respectively provide a limited through flow cross section and consequently also have a throttling influence on the supply of fuel to the fuel injection valve. A sufficient delivery of fuel to the fuel injection valve via the respective fuel injection process depends on the size of the reservoir, its pressure level, its refilling capacity, and lastly, the throttling in the high pressure lines. If these parameters are not taken into consideration to a sufficient degree, pressure influxes can occur during the respective fuel injection process in the fuel injection valve. Increasing the parameter that produces this kind of reduction in the fuel delivery, however, leads to considerable overdimensioning. In particular, though, throttling line connections between the high pressure reservoir and the fuel injection valve also have a considerable negative influence on the assurance of a particular pressure level due to the elasticity of the lines and the resultant variable absorption volumes when there are pressure changes, even when a sufficient quantity of high pressure fuel from the high pressure reservoirs is available.

OBJECT AND SUMMARY OF THE INVENTION

The fuel injection system according to the invention has the significant advantage that the harmful line connections are eliminated by virtue of the fact that the high pressure reservoir has connection points with which it is directly connected, respectively, to the housing of a number of fuel injection valves. In this manner, a throttling influence of line connections is prevented and there is the possibility of supplying the high pressure fuel to the pressure chamber in the fuel injection valve at a high refilling rate.

In an advantageous improvement, the high pressure fuel reservoir is embodied as a long, stretched-out hollow body which extends laterally to the longitudinal axis of the fuel injection valves. The direct connection of the high pressure fuel reservoir to the injection valves is thus assured and the above-mentioned short connections between the volume of the high pressure fuel reservoir and the pressure chamber in the fuel injection valve can be realized. The high pressure fuel reservoir is advantageously inserted into correspondingly adapted recesses in the housing of the engine. An embodiment set forth produces an effective, sealed, high pressure-tight connection between the high pressure fuel reservoir and the fuel injection valves. This does not depend on whether, as mentioned above, the high pressure fuel reservoir is inserted into a corresponding recess in the housing of the engine or is fixed to the engine in some other way. It is advantageous, though, if the high pressure fuel reservoir is inserted into a longitudinal conduit of the housing and fixed in position there, and the fuel injection valves, in the region of the connection point, are pressed against the stationary high pressure fuel reservoir. As a result, the air-tightness of each fuel injection valve can be individually tested and assured. A pressing piece is provided by means of which the fuel injection valves, with their housing in the region of their entry points, are pressed against exit points of the high pressure fuel reservoir. These entry points and exit points are encompassed by sealing faces, which assures the air-tightness under pressure. It is possible that with a given position fixing of the high pressure fuel reservoir in the region of the connection point between the fuel injection valve housing and the high pressure fuel reservoir, an aligning compensation can be realized.

Advantageous improvements and updates of the fuel injection system disclosed are possible by means of the measures taken hereinafter.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
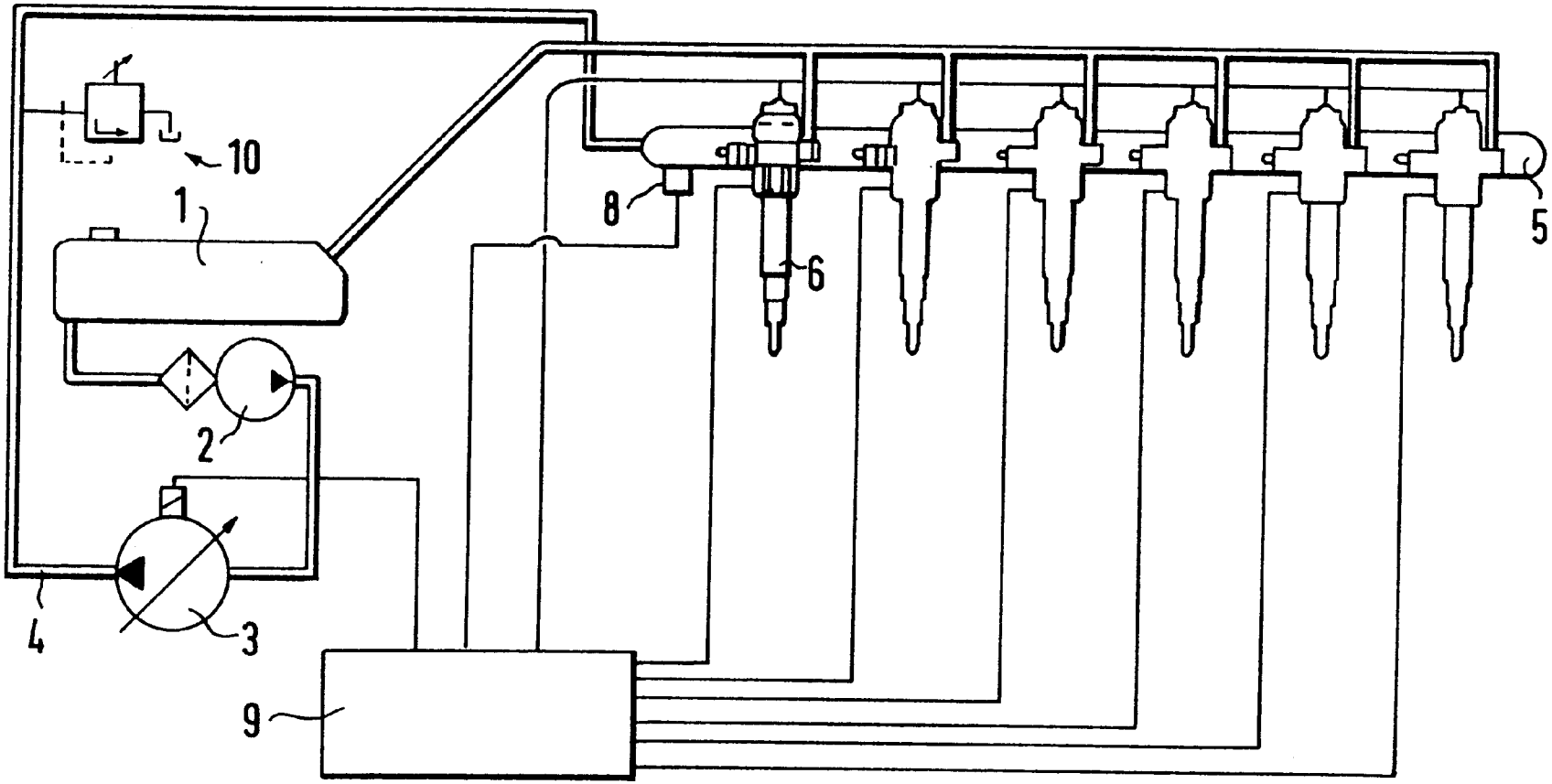
FIG. 1 is a schematic representation of the fuel injection system with the high pressure fuel reservoir and the fuel injection valves.

FIG. 1 is a schematic representation of the fuel injection system according to the invention. A pre-feed pump 2 delivers fuel from a high pressure fuel reservoir 1 to a high pressure pump 3, which is connected by way of a pressure line 4 to a high pressure fuel reservoir 5. The latter is supplied with fuel brought to injection pressure for delivery to fuel injection valves 6.

Figure 2:
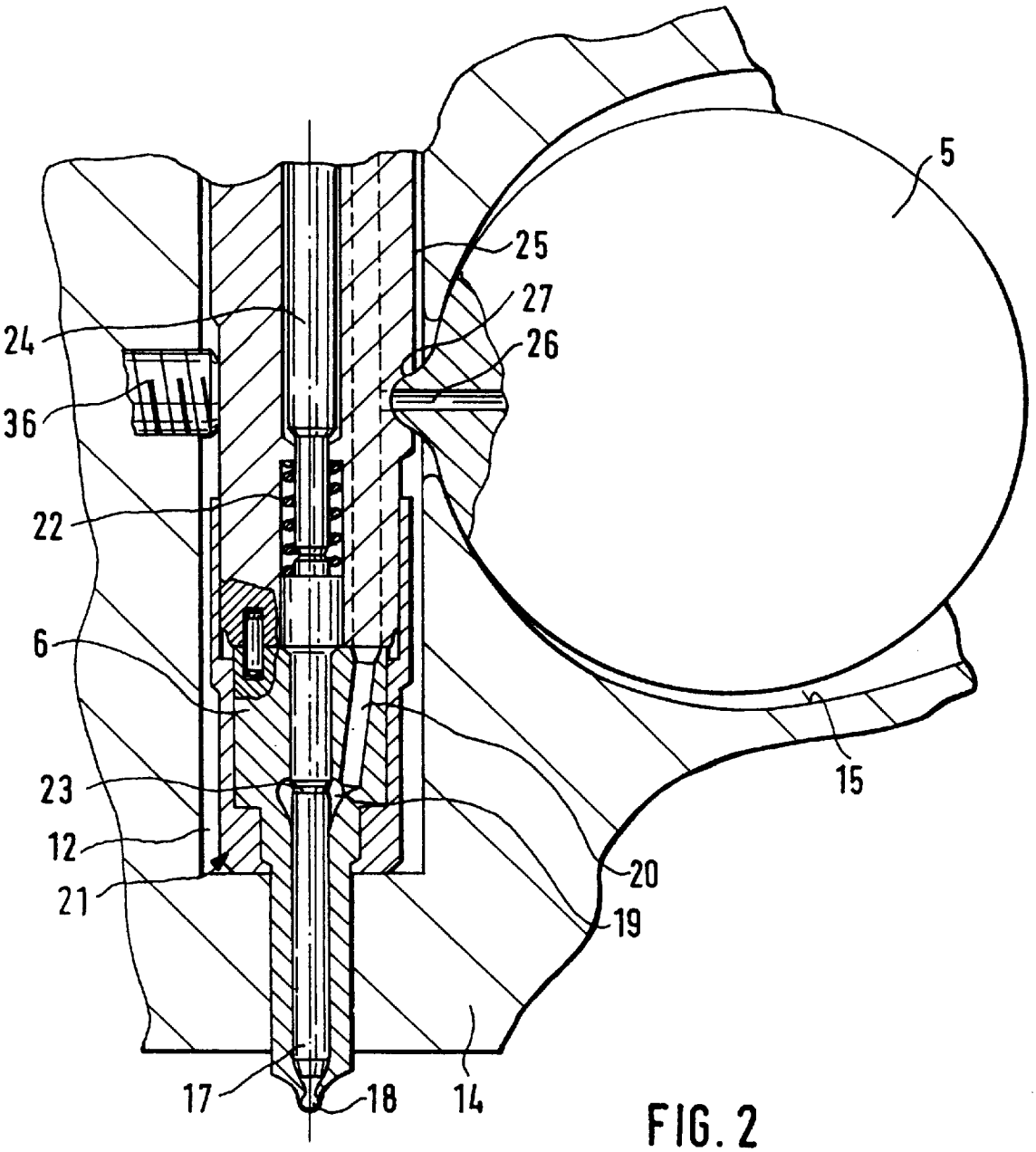
FIG. 2 is a partial section through the high pressure fuel reservoir and a fuel injection valve associated with it, in a first embodiment of the invention.

The pressure in the high pressure fuel reservoir 5 can be monitored with the aid of a pressure sensor 8 whose signals are detected by an electric control device 9, which in turn, as embodied here, controls the high pressure delivery output of the high pressure pump 3. In addition to this, a pressure control valve 10 is provided for safety reasons, which in another embodiment could also be used to control the pressure in the high pressure fuel reservoir 5 by means of a controlled discharge of the high pressure fuel reservoir 5 in lieu of the control of the high pressure pump mentioned. Furthermore, the control device 9 also controls the injection by way of the fuel injection valves 6, which are embodied as electrically controllable fuel injection valves. It can be inferred from FIG. 1 that the fuel injection valves are directly associated with the high pressure fuel reservoir 5. This association is shown somewhat more precisely in FIG. 2. This, in turn, depicts the high pressure fuel reservoir 5 that is fixed in its position by means that are not shown in detail. In addition, a part of a fuel injection valve 6 is shown in section, which is inserted in a recess 12 of the engine housing 14 in an axially and radially fixed manner. The high pressure fuel reservoir is, for example, likewise fixed in a recess 15, e.g. in the form of a longitudinal conduit in the engine housing 14.

The fuel injection valve 6 has a valve needle 17 that controls injection openings 18 in a known fashion. Upstream of these injection openings, a pressure chamber 19 is provided, which is supplied with fuel by a pressure line 20 that extends in the longitudinal direction in the housing 21 of the fuel injection valve. The injection valve needle is acted on in the closing direction by a compression spring 22. Counter to the force of this compression spring 22, which is supported on the fuel injection valve housing, a pressure shoulder 23 is provided, which is subjected to the pressure in the pressure chamber 19, and by way of this pressure shoulder, the injection valve needle 17 can be moved into the open position counter to the force of the spring by the force resulting from the pushing area and the pressure in the pressure chamber. In the elongation of the injection valve needle, though, a tappet 24 also functions, which is likewise subjected to the pressure of a pressure chamber in a manner not shown in detail here, and the pressure level of this pressure chamber can be changed with the aid of an electrically controlled valve. If this pressure chamber is discharged, then the valve needle 17 can be moved in the opening direction counter to the force of the compression spring 22. However, if the pressure is built up in the pressure chamber mentioned, then the tappet 24 presses the valve needle 17 into the closed position counter to its opening force.

The pressure line 20 is provided for supplying the pressure chamber 19 with fuel that has been brought to high injection pressure, and this pressure line has an entry point 27 on the jacket face 25 of the injection valve housing 21 in the center region of the longitudinal span of the injection valve housing. This entry point 27 is in sealed contact with an exit point 26 on the high pressure fuel reservoir 5. The entry point and the exit point constitute a connection point. To produce the air-tight connection, a pressing piece 36 presses the injection valve with its entry point onto the exit point 26. This can be more precisely inferred from FIG. 3. This Fig. in turn shows a part of the housing 21 of the fuel injection valve, with the pressure line or the pressure conduit 20 in it. A lateral conduit 28 branches off from this and ends in the region of a trough-shaped recess 29. This trough-shaped recess is let into the jacket face 26 of the injection valve housing 21 as a sealing face and is used to receive the exit point 26 on the high pressure fuel reservoir 5. The exit point is embodied as a projection 31 in an approximately knob-shaped fashion, with a ball-shaped surface 32, which is likewise finished as a sealing face. Radial to the longitudinal axis 33 of the high pressure fuel reservoir, a fuel conduit 34 emerges from the highest point of the projection 31 and is flush with the lateral conduit 28 when the high pressure fuel reservoir rests in a sealed manner against the fuel injection valve housing 21 and consequently produces a direct connection between the high pressure fuel reservoir 5 and the pressure conduit 20 or the pressure chamber 19 of the fuel injection valve.

In order to assure the sealed connection between the entry point 27 and the exit point 26, the pressing piece 36 is provided lateral to the longitudinal span of the fuel injection valve and this pressing piece enters into the recess 12 and is clamped to the injection valve housing 21 so that the valve is pressed with its entry point 27 against the exit point 26 of the high pressure fuel reservoir fixed in the longitudinal conduit 15. The ball-shaped embodiment of the projection 31 permits flush errors to be compensated for here. This permits a pairing in such a way that the surface of the projection 31 is ball-shaped, while the surface of the recess 29 is embodied as conical so that a contact line can be realized as a sealing edge. Nevertheless, a correspondingly adapted ball-shaped/trough-shaped combination can naturally also be produced between the entry point and exit point. Lastly, both connecting regions can also be realized in conical faces, wherein the flush error compensation in this instance is no longer possible to such a large extent. In particular, the cone angles must diverge from each other so that in the region of the projection 31, a conical face is provided with a smaller vertex angle of the cone being produced, while the correspondingly produced cone for the conical face on the fuel injection valve housing 21 would have to be correspondingly larger.

Figure 3:
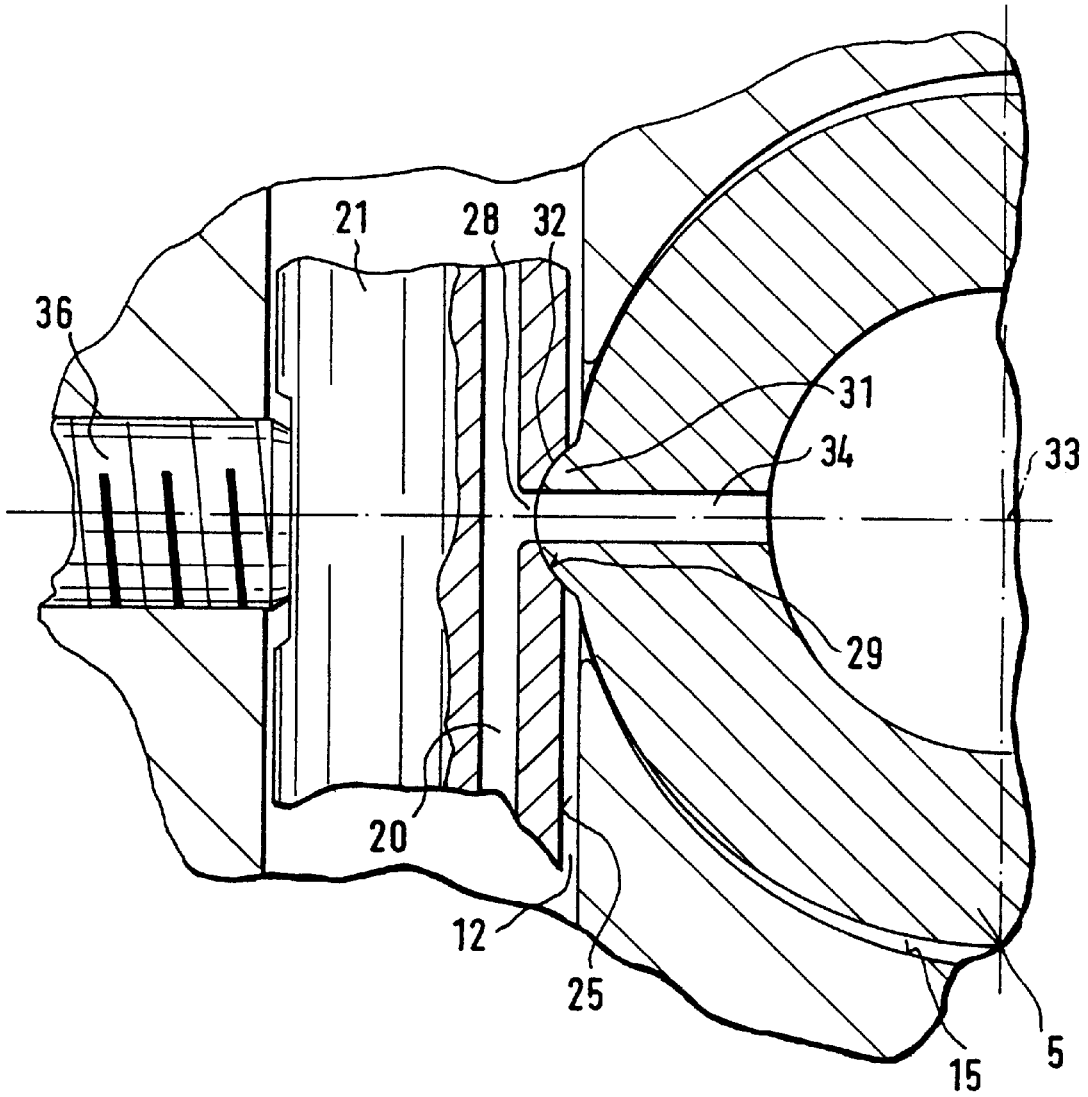
FIG. 3 is an enlarged depiction of the connection point between the high pressure fuel reservoir and the fuel injection valve.
Figure 4:
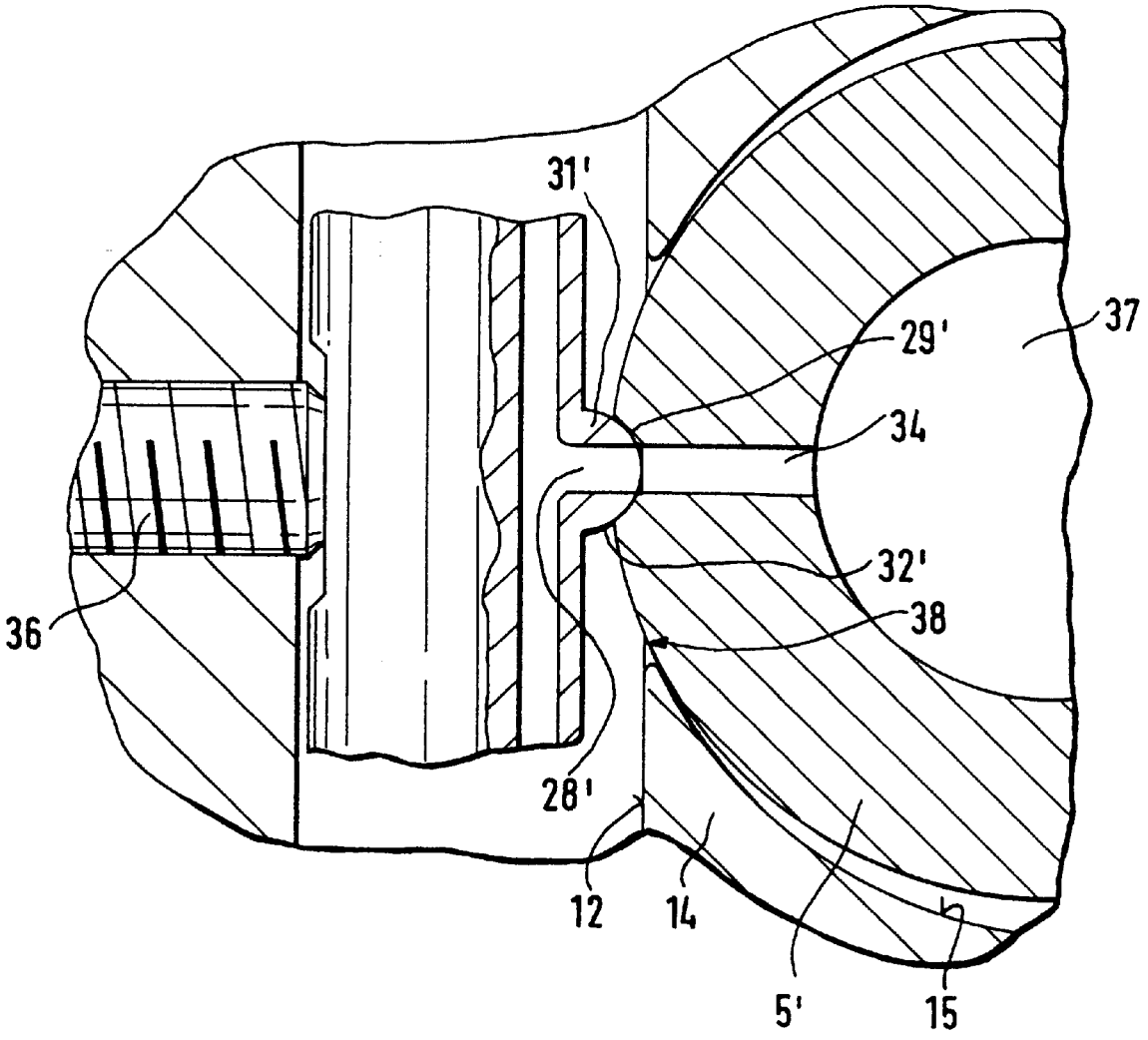
FIG. 4 shows a second embodiment of the connection between a fuel injection valve and the high pressure fuel reservoir.

An alternative to the embodiment 3 can be inferred from FIG. 4. In this instance, the projection is provided on the side of the fuel injection valve instead of on the side of the high pressure fuel reservoir. Analogous to the embodiment according to FIG. 3, this projection 31' is equipped with a ball-shaped surface 32', which is finished as a sealing face, and in this instance, the lateral conduit 28' in turn feeds to the highest point of this ball-shaped projection 31'. On the opposite side, the high pressure fuel reservoir 5' now has a trough-shaped recess 29', which can be either ball-shaped or conical and is likewise conceived as a sealing face. The conduit 34 then leads to this sealing face from the inside of the high pressure fuel reservoir with the inner chamber 37, which is kept filled with fuel by the high pressure fuel pump 3.

In both instances according to FIGS. 3 and 4, the projection mentioned bridges over an intersecting opening 38 between the recess 12 and the recess 15. This intersecting opening permits the connection between the high pressure fuel reservoir supported in the housing 14 of the engine and the fuel injection valve supported in this housing. The projection 31 or 31' is furthermore necessary in order to compensate for flush errors and to create the required free space for the pressing of the injection valve housing against the high pressure fuel reservoir so that a neck-shaped connection can be produced between the two. The pressing, which is produced in this instance by means of a pressing piece 36, can be produced in a different form and can also be individually adjusted at each connection point so that a precisely sealed connection is always permitted between the fuel injection valve and the high pressure reservoir, independent of the required manufacture and installation tolerances.

This embodiment according to the invention produces an extremely short connection between the high pressure fuel reservoir and the injection point on the fuel injection valve, which minimizes the throttle losses in the connection between the high pressure fuel reservoir and the injection point in the fuel injection valve.

The foregoing relates to preferred exemplary embodiments of the invention, it being understood that other variants and embodiments thereof are possible within the spirit and scope of the invention, the latter being defined by the appended claims.

We claim:

1. A fuel injection system for internal combustion engines, comprising at least one high pressure pump, a high pressure fuel reservoir (5) that is supplied with fuel by said at least one high pressure pump (3) and is for supplying a number of fuel injection valves (6) having at least one fuel injection opening (18) associated with the engine, a pressure chamber (19) upstream of said at least one injection opening (18), said pressure chamber is respectively connected to the high pressure fuel reservoir (5), the high pressure fuel reservoir (5) has connection points (26) with which said reservoir is directly connected to a housing (21) of a number of fuel injection valves (6), and said high pressure fuel reservoir (5)

is embodied as a long, stretched-out hollow body that extends laterally to a longitudinal axis of the fuel injection valves (6).

2. The fuel injection system according to claim 1, in which both the high pressure fuel reservoir (5) and the fuel injection valves (6) are inserted into correspondingly adapted recesses (12, 15) in a housing (14) of the engine.

3. The fuel injection system according to claim 1, in which the high pressure fuel reservoir (5) is fixed to the housing (14) of the engine so that the high pressure reservoir is disposed lateral to an axis of the fuel injection valves (6) and respectively forms the connection points there, wherein a recess (31, 31') is respectively provided on the fuel injection valve housing (21) or on the high pressure fuel reservoir (5) and said recess contains an entry point (27) into the fuel injection valve housing (21) or an exit point (16) on the high pressure fuel reservoir (5), wherein these parts are held in sealed contact against each other in a region of the connection point (26, 27) by means of a pressure exerted on one of the parts, the fuel injection valve housing or the high pressure fuel reservoir.

4. The fuel injection system according to claim 2, in which the high pressure fuel reservoir (5) is fixed to the housing (14) of the engine so that the high pressure reservoir is disposed lateral to an axis of the fuel injection valves (6) and respectively forms the connection points there, wherein a recess (31, 31') is respectively provided on the fuel injection valve housing (21) or on the high pressure fuel reservoir (5) and this recess contains an entry point (27) into the fuel injection valve housing (21) or an exit point (16) on the high pressure fuel reservoir (5), wherein these parts are held in sealed contact against each other in a region of the connection point (26, 27) by means of a pressure exerted on one of the parts, the fuel injection valve housing or the high pressure fuel reservoir.

5. The fuel injection system according to claim 3, in which the high pressure fuel reservoir (5) is inserted into a longitudinal conduit (15) in the housing (14) of the engine which conduit intersects recesses (12) for containing the fuel injection valves (6), and the connection point is embodied at the intersecting opening (38) between the longitudinal conduit (15) and each of the recesses (12), with a projection (31, 31') on the fuel injection valve housing (21) or on the high pressure fuel reservoir (5), which projection contains an entry point (27) into the fuel injection valve housing (21) or an exit point (26) on the high pressure fuel reservoir (5) and this projection (31, 31') respectively protrudes through the intersecting opening (38), wherein these parts are held in sealed contact against each other in the region of the connection point by means of a pressure exerted on one of the parts, the fuel injection valve housing or the high pressure fuel reservoir.

6. The fuel injection system according to claim 4, in which the high pressure fuel reservoir (5) is inserted into a longitudinal conduit (15) in the housing (14) of the engine, which conduit intersects recesses (12) for containing the fuel injection valves (6), and the connection point is embodied at the intersecting opening (38) between the longitudinal conduit (15) and each of the recesses (12), with a projection (31, 31') on the fuel injection valve housing (21) or on the high pressure fuel reservoir (5), which projection contains an entry point (27) into the fuel injection valve housing (21) or an exit point (26) on the high pressure fuel reservoir (5) and this projection (31, 31') respectively protrudes through the intersecting opening (38), wherein these parts are held in sealed contact against each other in the region of the connection point by means of a pressure exerted on one of the parts, the fuel injection valve housing or the high pressure fuel reservoir.

7. The fuel injection system according to claim 3, in which the fuel injection valve housing (21) is respectively pressed with its entry point (27) against one of the exit points (26) on the high pressure fuel reservoir (5) by means of a pressing piece (36).

8. The fuel injection system according to claim 4, in which the fuel injection valve housing (21) is respectively pressed with its entry point (27) against one of the exit points (26) on the high pressure fuel reservoir (5) by means of a pressing piece (36).

9. The fuel injection system according to claim 5, in which the fuel injection valve housing (21) is respectively pressed with its entry point (27) against one of the exit points (26) on the high pressure fuel reservoir (5) by means of a pressing piece (36).

10. The fuel injection system according to claim 6, in which the fuel injection valve housing (21) is respectively pressed with its entry point (27) against one of the exit points (26) on the high pressure fuel reservoir (5) by means of a pressing piece (36).

11. The fuel injection system according to claim 7, in which the entry points (27) and the exit points (26) are encompassed by a surface that is embodied as a sealing face (29, 32).

12. The fuel injection system according to claim 8, in which the entry points (27) and the exit points (26) are encompassed by a surface that is embodied as a sealing face (29, 32).

13. The fuel injection system according to claim 11, in which the sealing face of one of the parts, of the fuel injection valve housing or of the high pressure fuel reservoir, is respectively embodied as conical and the sealing face of the other of these parts is embodied as ball-shaped.

14. The fuel injection system according to claim 12, in which the sealing face of one of the parts, of the fuel injection valve housing or of the high pressure fuel reservoir, is respectively embodied as conical and the sealing face of the other of these parts is embodied as ball-shaped.

15. The fuel injection system according to claim 11, in which the sealing faces of both parts, of the fuel injection valve housing and the high pressure fuel reservoir, are embodied as ball-shaped, with differing ball-radii.

16. The fuel injection system according to claim 12, in which the sealing faces of both parts, of the fuel injection valve housing and the high pressure fuel reservoir, are embodied as ball-shaped, with differing ball-radii.

17. The fuel injection system according to claim 11, in which the sealing faces of both parts, of the fuel injection valve housing and the high pressure fuel reservoir, are embodied as conical, with differing cone angles.

18. The fuel injection system according to claim 12, in which the sealing faces of both parts, of the fuel injection valve housing and the high pressure fuel reservoir, are embodied as conical, with differing cone angles.

* * * * *